United States Patent [19]

Faulkner

[11] 4,070,943

[45] Jan. 31, 1978

[54] ELECTRONIC ORGAN KEYING SYSTEM

[76] Inventor: Alfred H. Faulkner, 1324 Portesuello Ave., Santa Barbara, Calif. 93105

[21] Appl. No.: 610,772

[22] Filed: Sept. 5, 1975

[51] Int. Cl.[2] ..... G10H 1/00

[52] U.S. Cl. ..... 84/1.01; 84/1.11; 84/1.19

[58] Field of Search ..... 84/1.13, 1.26, 1.01, 84/1.11, 1.19, 1.24, 1.17, DIG. 8, DIG. 23, DIG. 7, 1.25, 1.22, 1.23, 1.03; 307/242, 243; 317/235; 331/47; 330/10; 332/31 T

[56] References Cited

U.S. PATENT DOCUMENTS

| | | | |
|---|---|---|---|
| 3,355,539 | 11/1967 | Munch et al. | 84/1.01 X |
| 3,534,144 | 10/1970 | Ring | 84/1.01 |
| 3,535,969 | 10/1970 | Bunger | 84/1.11 |
| 3,544,699 | 12/1970 | Harris | 84/1.26 |
| 3,585,487 | 6/1971 | McNally | 307/242 X |
| 3,617,598 | 11/1971 | Woody | 84/1.01 |
| 3,636,231 | 1/1972 | Schrecongost et al. | 84/1.26 X |
| 3,861,263 | 1/1975 | Okudaira | 84/1.26 X |

OTHER PUBLICATIONS

Hofstein et al., "The Silicon Insulated-Gate Field-Effect Transistor," Proceedings of the IEEE, pp. 1190-1202.

*Primary Examiner*—Ulysses Weldon

[57] ABSTRACT

An organ is described in which a small number of note generators, each comprising a binary divider, a group of keyers, and an envelope generator, serves an entire keyboard. Each note generator is selectively operable by multiplexed signals from a keyboard to produce either of two adjacent notes in any octave interval. Six of these note generators are provided for each manual of a spinet size organ. A seventh note generator, which is selectively operable to produce any of the notes available from the other six, is provided together with selection circuitry which causes the seventh note generator to augment any one of the other six which is called upon to produce two adjacent, or two octavely related, notes simultaneously. The pitch of all notes is determined by a set of top octave dividers which drive the binary dividers individual to each note generator. Synchronizing circuitry is provided to control the phase relation between binary dividers, when they are driven by a common source, to avoid cancellation effects. The group of keyers in each note generator includes a number which key square waves at octavely related footages. The tone signals from these keyers are combined and filtered to produce various voice qualities selectable by stop switches in a conventional manner. Other keyers of the group act as sine wave synthesizers to produce outputs which are practically devoid of third and fifth harmonics, using digital circuitry controlled by the binary divider outputs. The remaining harmonics are effectively eliminated by integration, allowing these keyer outputs to be used for additive synthesis generation of desired tone timbres. Additional top octave tone sources and binary dividers are provided to obtain true third, fifth and sixth harmonics with these keyers.

8 Claims, 24 Drawing Figures

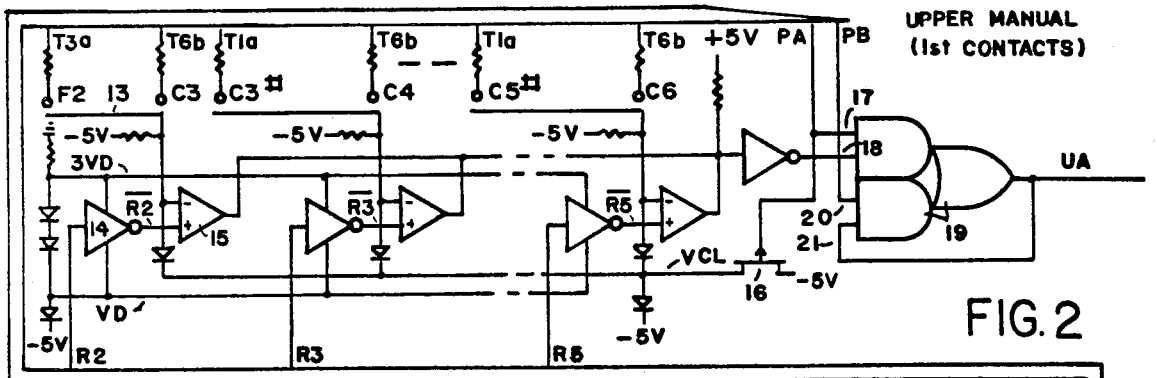
FIG. 2
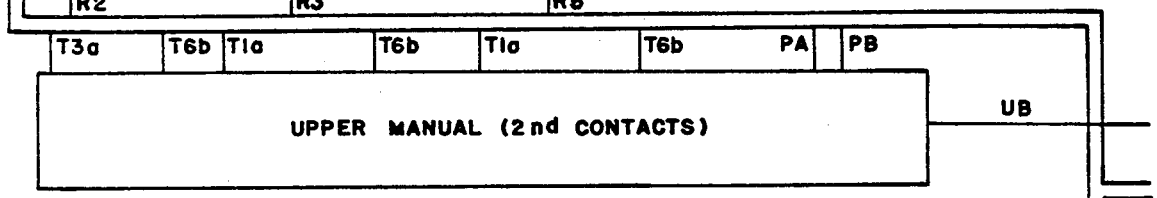
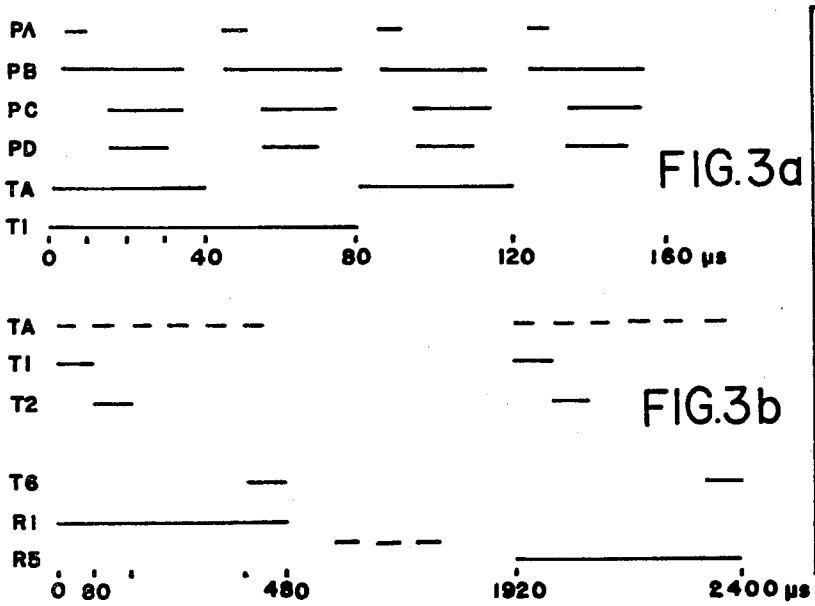
FIG. 3a
FIG. 3b
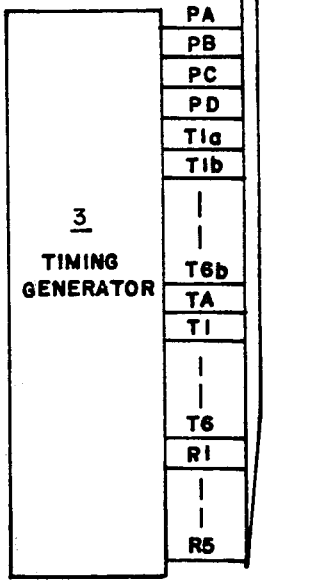
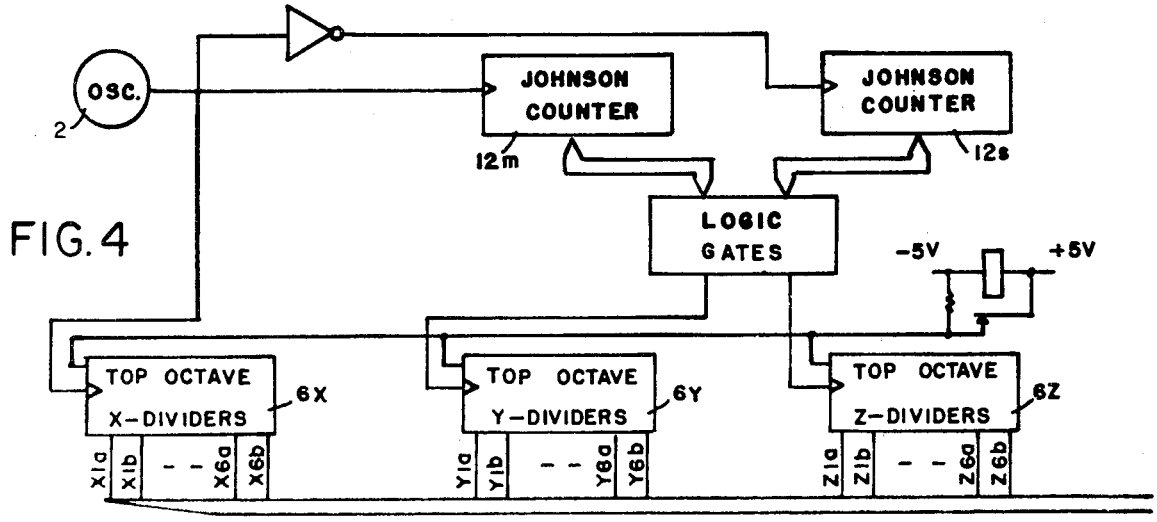
FIG. 4

FIG. 13
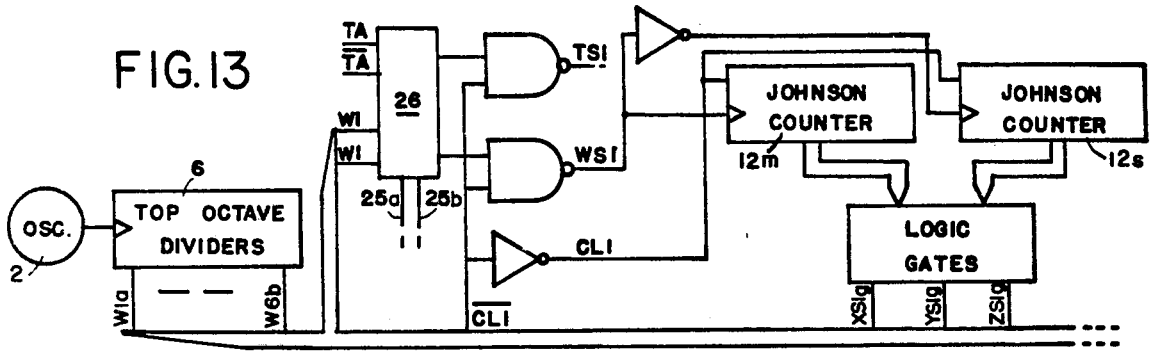
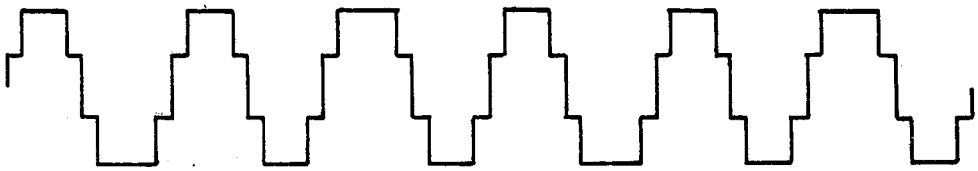
FIG. 14a
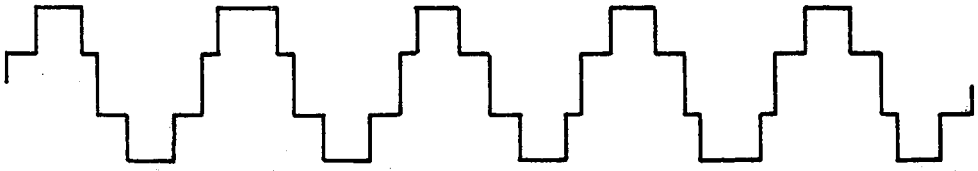
FIG. 14b
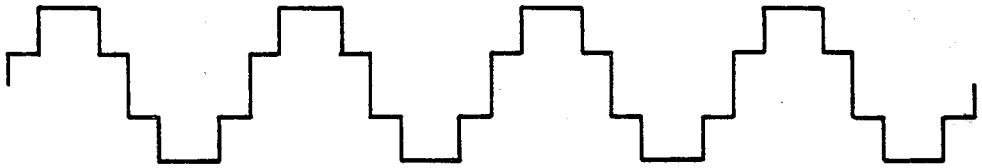
FIG. 14c
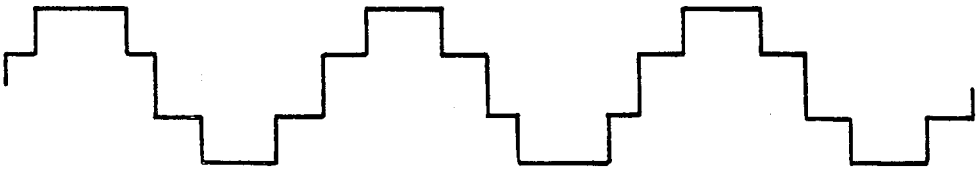
FIG. 14d

ELECTRONIC ORGAN KEYING SYSTEM

This application is related to my co-pending application, entitled "Electronic Organ Keying System", filed concurrently herewith, Ser. No. 610,733, now U.S. Pat. No. 4,008,377.

SUMMARY OF THE INVENTION

Binary dividers are selectively connected to top octave dividers in response to keyboard operations to operate at corresponding rates in an octavely related set. Each set may include a pair of chromatically ordered notes. One or more auxiliary binary dividers may be included to augment the primary dividers when keyboard operations call for concurrent operation of two or more notes in the same set.

A plurality of keyers is associated with each binary divided to generate tone signals at octavely related footages. The attack, decay and release times and sustain level are controlled by an envelope generator individual to each group of keyers. Variable voltage sources, or variable resistors, common to a set of envelope generators select the desired ADSR characteristics. The amplitude of the envelope generator output is varied in accordance with the velocity of the associated key operation to provide a touch responsive action.

When additive synthesis of desired timbres is required, two additional top octave divider sets are provided and are driven by a rate multiplier to provide outputs that are octavely related to the third and fifth harmonics of the first set. Second and third binary dividers corresponding to each of the first binary dividers are provided to drive keyers at the third, fifth and sixth harmonics of the selected fundamental rate. The keyers used for additive synthesis, or sine wave component, tones are each controlled by multiple outputs of the associated binary divider and are arranged to produce an output tone signal that is essentially devoid of third and fifth harmonics using circuitry that is independent of frequency. The envelope control signal for these keyers is pre-emphasized in accordance with the selected pitch to compensate for integration of the keyer outputs, which effectively eliminates the remaining harmonics in these signals.

In one modification of the invention the fifth and sixth harmonic sources are derived from the output of the first top octave divider using a rate multiplier individual to each note generator. Since only one top octave divider is used with this arrangement, fewer signal inputs to each note generator are required which facilitates use of large scale integration to implement the organ.

The principal object of the invention summarized in the foregoing is to enable an electronic organ having greater flexibility and capability than conventional electronic organs to be produced economically through use of a system organization and novel circuitry that facilitates implementation in LSI form.

BRIEF DESCRIPTION OF THE DRAWINGS

FIG. 2 is a schematic diagram of the upper manual and the associated interface circuits together with a block representation of the timing generator.

FIGS. 3*a* and 3*b* are timing diagrams showing the characteristics of various signals used for control timing and multiplex operations.

FIG. 4 is a block diagram of the top octave dividers and associated rate multiplier for one manual.

FIG. 13 is a schematic diagram of a modified form of note generator wherein an individual rate multiplier is provided to enable all harmonics to be derived from a single input.

FIG. 14*a* through 14*d* illustrate some of the waveforms produced by the sine wave keyers when the modification shown in FIG. 13 is used.

DESCRIPTION OF THE PREFERRED EMBODIMENTS

General Description Of Operation

Figure 1:
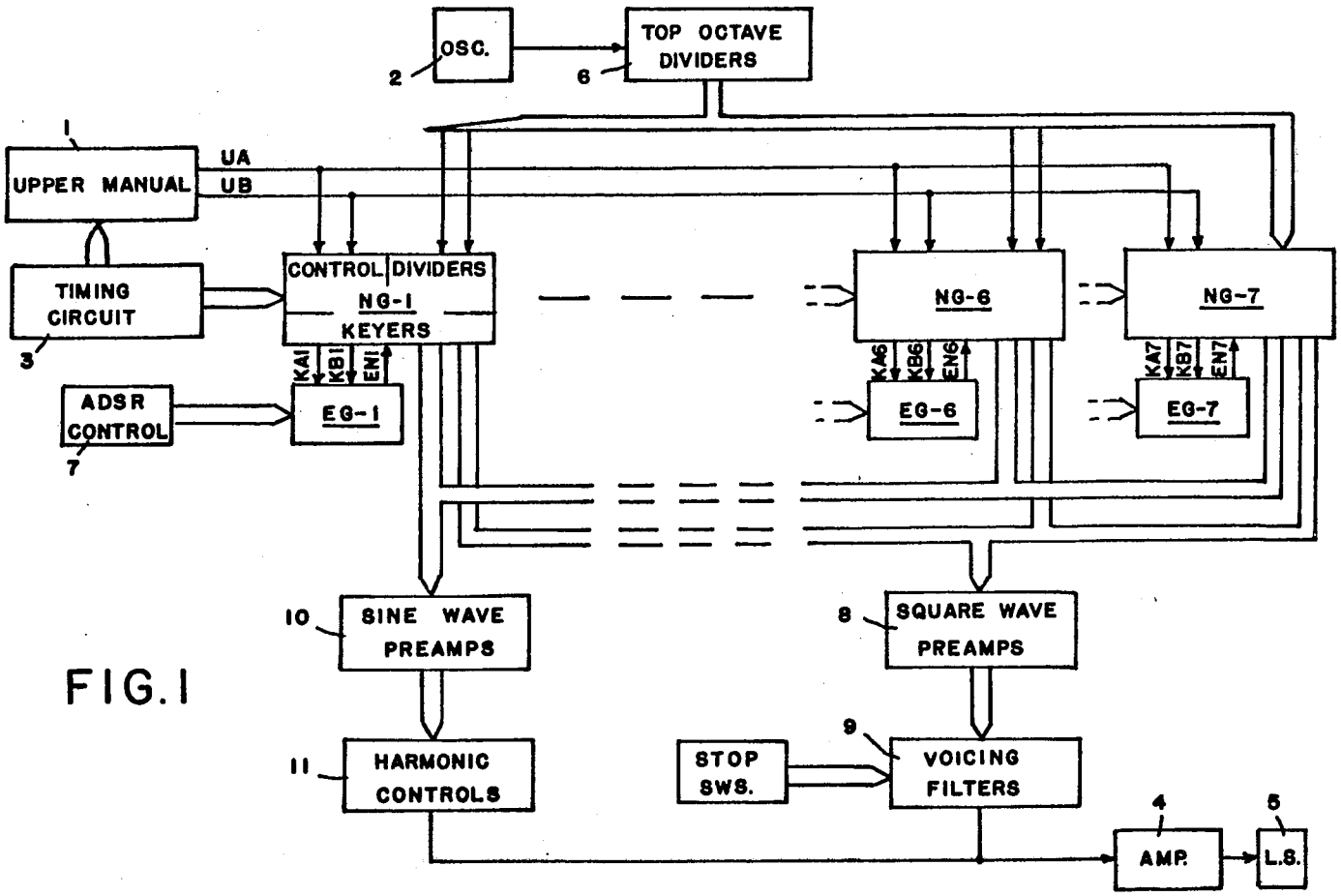
FIG. 1 is a block diagram of one embodiment of the invention illustrating the system organization for one manual of a spinet size organ.

The organization of the spinet organ embodiment is illustrated by the block diagram in FIG. 1 which shows the functional blocks associated with each one of two manuals. The oscillator 2, timing circuits 3, and audio output system 4 and 5 are shared by both manuals; but the remaining blocks, including the top octave dividers 6, are individual to the upper manual 1. Each manual has 3½ octaves and they are offset one octave in the normal spinet organ manner. Since this type of organ is normally played with the right hand on the upper manual and the left hand on the lower manual, at most five keys are depressed simultaneously on either manual. Furthermore, rarely, if ever, are adjacent keys, i.e. spaced one semitone apart, depressed simultaneously for more than the brief overlap required to play in legato fashion. The present organ takes advantage of these facts to reduce the number of keyers and envelope control circuits required as compared with other spinet organs of comparable capabilities. Conversely, by reducing the number of such circuits required, it becomes economically practical to provide electronic keying and envelope control for all voices and all notes, rather than a selected few.

This economy in circuits is accomplished by providing six sets of note generators, each including, control, divider and keyer sections, and envelope generators; each set being capable of producing either one of the corresponding pair of adjacent notes at any octave interval of the manual. For example, one note generator (NG-1) and envelope generator (EG-1) are used to produce any one of the six notes C#3, D3, C#4, D4, C#5, or D5. Similarly, NG-2 produces any one of the D# or E notes, NG-3 produces F or F#, NG-4 produces G or G#, NG-5 produces A or A#, and NG-6 produces B or C.

If only these six note generators were provided, NG-6 and EG-6 would have to switch suddenly from note B to C when playing a scale in the key of C. Other note generators would be involved in other keys. To overcome the discontinuity in the tone envelopes which would result from this circuit sharing, a seventh note generator (NG-7), or tone unit, is provided. The seventh unit is functionally unique in that it is capable of producing any note that any of the other units can produce. This unique capability can be achieved by selection circuitry physically external to the NG-7 assembly so that it can be interchangeable with its counterparts. The universal character of NG-7 also enables its use to sound notes an octave apart simultaneously, which is commonly required, in addition to the use described above.

The above described organization of the seven tone units lends itself readily to the use of multiplex control circuits. For example, a single buss UA is used to select one of the tone units and determine which note it produces in response to the depression of a playing key. The keyswitches associated with UA are arranged to close early in the keystroke, say when the key is at ¼ stroke. A second set of keyswitches is arranged to close later in the keystroke, say at ¾ stroke. The latter switches generate multiplex signals on a second buss UB. The selected note generator NG converts the multiplexed signals on the UA and UB busses into steady state signals KA and KB which control its associated envelope generator EG. The latter circuit generates a low level waveform, shaped in accordance with the settings of the ADSR controls 7, and amplifies it to a level dependent on the time that elapses between the first occurrence of the UA and UB signals, which is inversely proportional to the velocity of the key being depressed. The amplified envelope controlling signal EN is applied to keyers in the note generator NG to control numerous octavely related square wave tone signals and harmonically related sine wave tone signals simultaneously.

The square wave tone signals of corresponding footages are collected and amplified by common preamplifiers 8 and thereafter applied to conventional voicing filters 9. The sine wave tone signals are produced from square waves in the note generator by a keyer that also functions as a synthesizer to produce a waveform that is practically devoid of third and fifth harmonics. The remaining harmonics are attenuated in the succeeding preamplifiers 10, which are connected as integrators. These preamps 10 are common to all note generators NG of the upper manual 1. Their outputs are mixed in any proportions desired by the player using slider type attenuators 11 before being sent to the power amplifier 4.

Top Octave Dividers

In the present organ there are three top octave dividers. One, 6X in FIG. 4, is driven at the 10.0808 Mhz output of oscillator 1. The division ratios and resulting output frequencies are shown in Table 1 below. It should be noted that there are no simple whole number ratios between any notes, such as in the diatonic scale, which would complicate the problem of synchronizing the binary dividers in the note generators so as to avoid cancellation effects.

TABLE I

| | X-DIVIDER OUTPUT FREQUENCIES | |
|---|---|---|
| OUTPUT | DIVISION RATIO | OUTPUT FREQUENCY |
| X1a | 569 | 17,716.6 |
| X1b | 537 | 18,772.4 |
| X2a | 506 | 19,922.5 |
| X2b | 478 | 21,089.5 |
| X3a | 451 | 22,352.1 |
| X3b | 426 | 23,663.8 |
| X4a | 402 | 26,076.6 |
| X4b | 379 | 26,598.4 |
| X5a | 358 | 28,158.6 |
| X5b | 338 | 29,824.8 |
| X6a | 319 | 31,601.2 |
| X6b | 301 | 33,491.0 |

The outputs from 6X are selected as required to drive the X dividers in the note generators from which the "bright" tones are obtained by combining square waves at 16', 8', 4', 2', and 1' footages and applying these mixtures to conventional voicing filters. These square waves are also used to generate sine waves which are designated subharmonic (SH), fundamental (1H) and the octave harmonics (2H, 4H and 8H). Sine waves at pitches corresponding to the third, fifth and sixth harmonics are also generated from square wave sources. Exact harmonics, rather than pseudo harmonics borrowed from the equal tempered scale, are obtained by providing two additional top octave dividers, 6Y and 6Z in FIG. 4, which are identical to divider 6X. The desired 7.5606 Mhz and 6.3005 Mhz pulse rates for driving these two dividers are obtained by driving a pair of four stage Johnson counters **12*m* and 13*s*** out of phase at 10.0808 Mhz and encoding the sixteen output states, per 0.79359 microsecond cycle, to obtain five pulses per cycle (6.3005 Mhz) and six pulses per cycle (7.5606 Mhz).

TIMING GENERATOR

The timing generator 3 in FIG. 2 operates at an internal 200 khz clock rate to produce four pulse trains PA–PD having repetition rates of 25 khz and a fifth pulse train TA having a repetition rate of 12.5 khz, all having the duty cycles and time relationships depicted in FIG. **3*a***. These pulse trains can readily be produced using an eight state Johnson counter. A second Johnson counter, having six states, can be used to produce the six pulse trains T1–T6 all having a duty cycle of 1/6 with a period of 480 μs, and having the time relationship shown in FIG. 3*b*. Each of the six note generators has a corresponding one of these pulse trains, or time slots, assigned to it. A third Johnson Counter, having five states, can be used to produce five more pulse trains, R1–R5, all having a duty cycle of 1/5 with a period of 2.4 ms, and having the time relationship shown in FIG. 3*b*. It should be noted that the pulse train TA coincides with the first half of each of the timing pulses T1–T6, whereby twelve time slots T1*a*, T1*b*, T2*a*, T2*b*, T3*a*, T3*b*, T4*a*, T4*b*, T5*a*, T5*b*, T6*a*, T6*b*, corresponding to the twelve notes of the equal tempered musical scale are obtained. These twelve pulse trains extend to corresponding note keys of the keyboard 1. It may also be noted that each of the R1–R5 pulses coincides with one full cycle of the twelve pulses T1*a*–T6*b*, whereby each key of a five octave keyboard can be identified by a pair of T1*a*–T6*b* and R1–R5 pulses, as will be described in the following section.

Keyboard Interface

The upper manual, or keyboard, proper is shown in FIG. 2 along with the interface circuitry. The resistors shown in series with the movable key contacts provide isolation between timing sources when several keys are operated concurrently. They can have a value of 100K ohms, but it is not critical. The keyboard has two sets of contacts, but only one is shown. Separate collector busses, such as 13, are provided for each octave and each set of contacts. The upper contacts shown, such as F2, close at about ¼ of the keystroke and the lower contacts, not shown, close at about ¾ of the keystroke. The ends of the resistors away from the movable contacts are paralleled with the corresponding resistors in other octaves to twelve leads, T1*a*–T6*b* from the timing generator. Thus all C# contacts are connected through resistors to T1*a*, all D contacts are connected to T1*b*, etc.

Leads R2–R5 from the timing circuit are connected to level shifting inverters, such as 14, to obtain outputs $\overline{R2}$–$\overline{R5}$ which swing sequentially from three diode drops above −5V (3VD) to one diode drop above −5V (VD). The normal levels for all logic signals are +5V for high, or true, and −5V for low, or false. These outputs are connected to corresponding inputs of comparators, such as 15, associated with each of the collector busses, such as 13, whereby these busses are scanned sequentially from the low to the high end of the keyboard. Since the individual notes associated with each buss are scanned sequentially from C# - C by the T1*a*–T6*b* timing signals, the combined effect is to scan the entire keyboard from bottom to top. Scanning of the lower manual, not shown, commences with R1 whereas scanning of the upper manual commences with R2, corresponding to the one octave offset of the spinet length keyboards.

Depression of a key, such as C3, causes the corresponding collector buss, such as 13, to rise from −5V to one diode drop above −5V during the major portion of the corresponding time period, such as T6*b*. During the 5 μs strobe portion (PA) of this time period the buss will rise two diode drops since JFET 16, which normally shunts lead VCL to −5V, is cut off during the strobe pulse. The comparator 15 is unaffected by the signal at its inverting input except during the period when $\overline{R2}$ lowers its non-inverting input from 3VD to VD. Since the combination of a true signal on the inverting input and a false signal on the non-inverting input is required to affect comparator 15, it performs an AND function. During this interval, the comparator 15 drives its output to −5V for the duration of the PA pulse, at least, causing coincident high logic level signals to appear at inputs 17 and 18 of AND-OR select gate 19. This gate latches its output UA to pulse PB via its inputs 20 and 21 to ensure an output pulse duration of at least 25 μs. The comparators, such as 15, have dedicated collector sink switch type outputs, hence the paralleled comparator outputs perform a wired-OR function.

At the end of the strobe pulse, VCL is again clamped to −5V by JFET 16 to restore the buss 13 to one diode drop above −5V so that it will be restored quickly towards −5V at the end of the T6*b* pulse.

The 25 μs minimum duration output pulse on UA is repeated every 2.4ms as long as the C3 key is held down. A 25 μs minimum duration output pulse is produced on UB in like manner during subsequent scans in response to the later closure of the lower C3 contacts.

Note Generator Control

Figure 5:
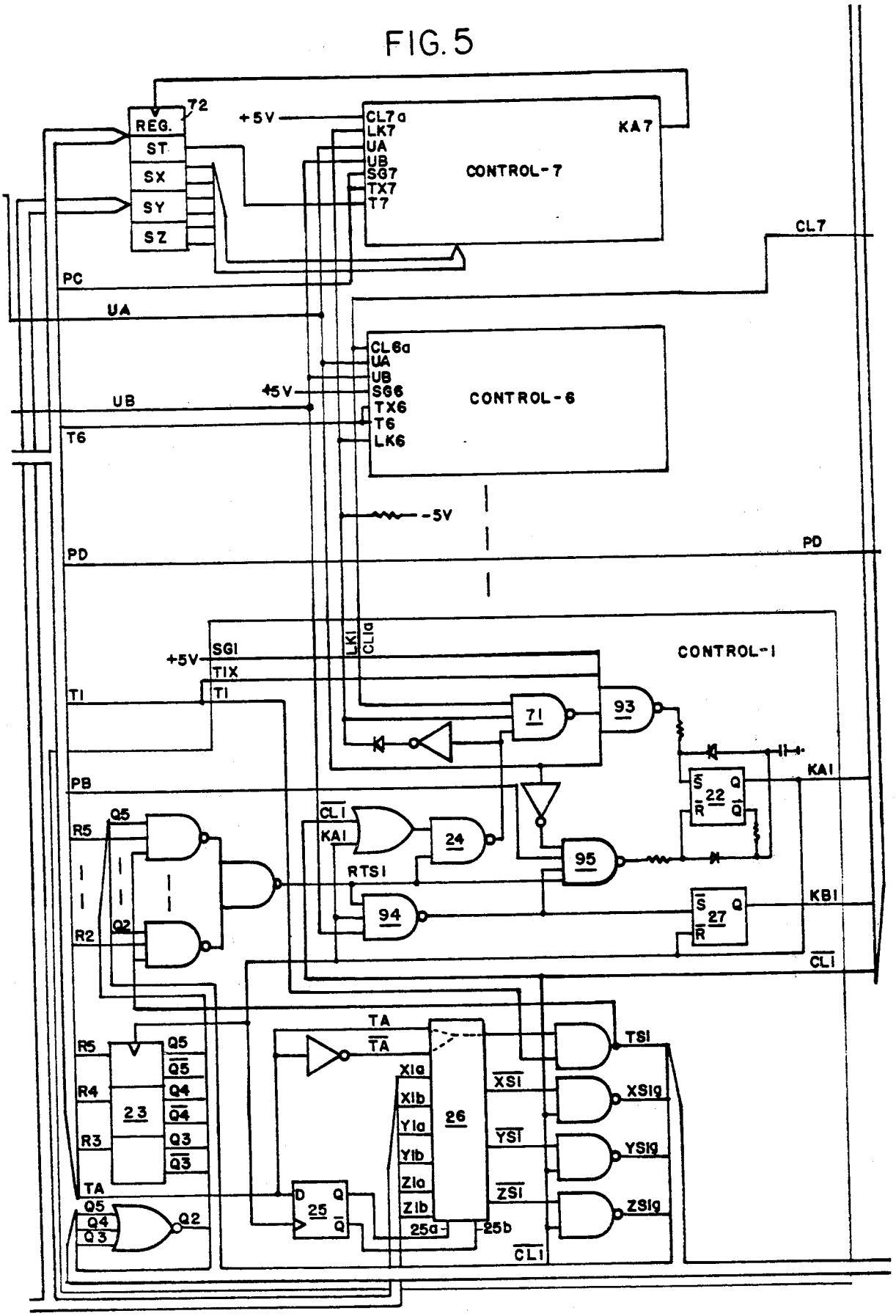
FIG. 5 is a schematic diagram of the control section of one note generator and a block diagram showing the interconnections required between the seven note generators of one manual of the spinet organ embodiment chosen for illustration.

FIG. 5 shows the control circuitry details of one of seven identical circuits. Control-1 shown is assigned to the T1 pair of time slots, corresponding to notes C# and D. Assuming that key C#3 is depressed, the first pulse on UA occurring at T1*a*-R3 time sets flip-flop 22 which clocks the octave register 23 making Q3 alone true. RTS1 immediately becomes true, causing the output of gate 24 to become low cyclically at T1*a*-R3 time. Lead LKI is consequently driven true cyclically at T1*a*-R3 time to lockout Control-7 to the T1*a*-R3 pulse train on UA. Flip-flop 25 is also clocked by the true output KA1 of 22 and is consequently true because its input TA is true at this time. AND-OR select gate 26 is set by 25*a* to select the "*a*" set of top octave tone signals together with timing signal TA. The KA1 rise also initiates the operation of the touch response circuit of the envelope generator, as will be described later. The RC circuit connected to the $\overline{Q}$ output of 22 inhibits resetting of 22 for a brief time in case there is contact chatter, although this was not found to be a problem with the keyboards employed by the inventor during the downstroke of the keys. When the second key contact is closed flip-flop 27 is set, making KB1 true. The true signal on KB1 terminates the touch response measurement interval in the envelope generator.

Figure 6:
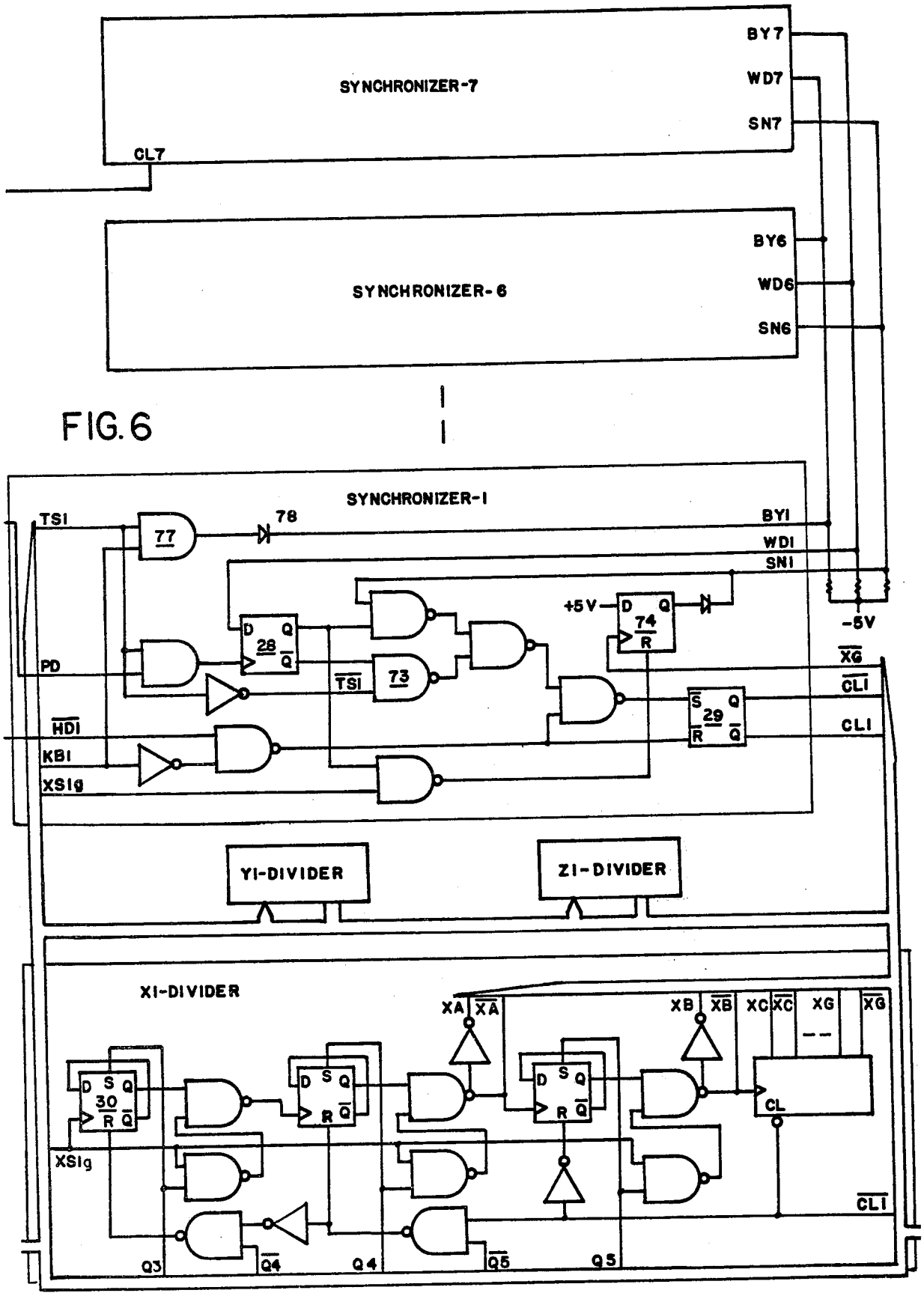
FIG. 6 is a schematic diagram of the synchronizer section and one binary divider of the first note generator, with block representations of the other two binary dividers, and a block diagram showing the synchronizer interconnections for the seven note generators.

Referring now to FIG. 6, flip-flop 28 was set in accordance with the state of signal WD1 when timing pulse TA was gated to lead TS1 in Control-1. Since NG-7 is assumed to be idle, its busy signal output to BY7 is low, hence flip-flop 28 is set false. This flip-flop determines whether the dividers will be started immediately in response to the subsequent closure of the second key contact or will wait to start in synchronizm with a harmonically related tone generator already in operation. At the end of the TA time period, during which KB1 became true, $\overline{TS1}$ goes true and causes flip-flop 29 to be set making CL1 false. Signal $\overline{CL1}$ holds the X1, Y1, and Z1 dividers in the zero state when CL1 is true. Now when it goes false, all three dividers start counting with the next pulse on their respective inputs from the selected set of three top octave divider outputs. X1*a*, Y1*a* and Z1*a*. A substantially fixed phase relationship between like frequency components in tone signals generated by these three dividers is thus achieved at each start. The keyers are permanently connected to the dividers and the pitch produced is determined by changing the division ratio at the top end of the dividers. Thus, with C3 depressed only Q2 is true causing the XS1 input to be connected to the clock input of flip-flop 30. in this case the X1 divider outputs XA and $\overline{XA}$ are two octaves below the XS1 input frequency. When key C5 is depressed the XA and $\overline{XA}$ outputs are at the XS1 frequency, and when C6 is depressed the XA and $\overline{XA}$ outputs are inactive. Similar operations occur in the Y1 and Z1 dividers. All of the dividers provide tone signals and control signals to the several types of keyers described in the following section.

Square Wave Keyers

One square wave keyer is provided for each of seven footages 16' through 1'. The mutation footages, 2⅔' and 1⅓', are obtained from the Y1 divider and hence produce tone signals that are exact multiples of the 8' tone signal. All of these keyers are the same as that shown for 16' and comprise a pair of analog switches, such as 32 and 33, and a series resistor connected between the junction of the two switches and a summing junction, such as 31, which is common to all note generators associated with one manual. The analog switches, which are preferably field effect transistors having no offset voltage, are switched on alternately during successive half cycles of the tone signal inputs from the dividers.

Figure 7:
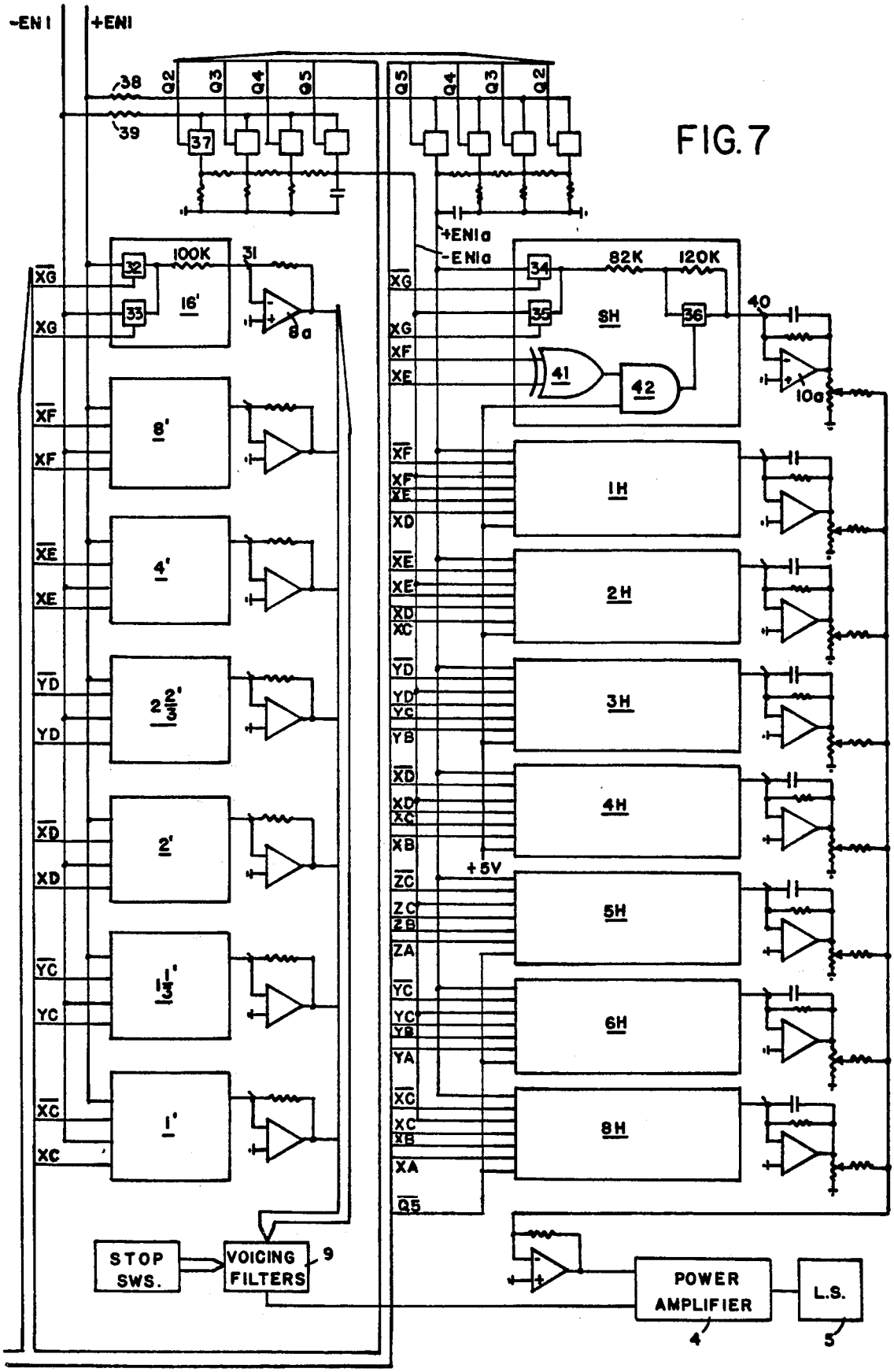
FIG. 7 is a block diagram of the keyer section of a note generator with schematic diagrams of representative square wave and sine wave keyers.

When the dividers first start, the envelope inputs +EN1 and −EN1 in FIG. 7 are at ground. The keyer outputs, such as 31, are also at ground, hence the alternate operation of a pair of switches, such as 32 and 33, produces no output signal initially. As the envelope signals rise, i.e. in absolute magnitude, a proportional alternating current flows through each of the 100K resistors from the corresponding pair of switches, such as 32 and 33, to the corresponding preamplifiers, such as 8*a*. Although these keyers could be operated single-ended by eliminating one switch of each pair, the balanced arrangement is preferred because it positively eliminates any key thump.

Figure 11A:
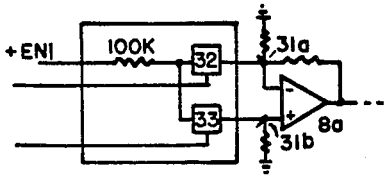
FIGS. 11*a* through 11*d* are schematic diagrams showing alternative forms of the keyer circuits.

At the expense of additional output pins, these keyers can be reversed by providing a single envelope buss, connecting the 100K resistors between the envelope signal buss and the switches and connecting the other side of the switches to the differential inputs of the preamplifiers, as shown in FIG. 11*a*. In either case the preamplifier 8*a* is common to the 16' outputs of all seven note generators associated with the upper manual.

Sine Wave Keyers

These keyers, each comprising three switches, such as 34–36, and the associated control circuits in FIG. 7 are designated "sine wave" keyers because they are designed to produce relatively pure signals at the output of the integrating preamplifiers, such as 10*a*, connected to these keyers. The purity of these signals is adequate for use as harmonic sources in an additive type tone synthesis system.

To compensate for the 6db/octave attenuation of the integrating preamps 10, the +EN1 and −EN1 signals from the envelope generator are connected to ladder networks by switches, such as 37, under control of the octave register so as to provide output signals on +EN1a and −EN1a that increase, in absolute amplitude, in steps of 6db/octave. Different valued resistors 38 and 39 are used in different note generators to provide 1db steps between adjacent note pairs. The geometrical mean value is used in note generator NG-7.

The two envelope signal busses +EN1a and −EN1a are connected alternately to the 82K and 120K ohm series resistors of each keyer by the polarity control analog switches, such as 34 and 35. These switch pairs determine the pitch of the keyer output at the summing junction, such as 40. The third switch of each keyer, such as 36, shunts the 120K ohm resistor during the second and third quarters of each half cycle to modulate the tone signal output current as shown in FIG. 14c. An exclusive-or gate, such as 41, driven by the first and second divider outputs above that driving the polarity switches, such as 34 and 35, is used to derive the control signal for the third keyer switch, such as 36. This method is preferred from implementation in integrated form; but requires higher frequency top octave dividers than those used in conventional electronic organs. The equivalent of the exclusive-or output can be obtained with a comparator having a triangular wave. derived by integrating the divider output one octave above that driving the polarity switches, applied to one input and ground applied to its other input.

The harmonic composition of the square wave generated by the polarity switches along, i.e. with the third switch continuously closed, is shown as W1 in Table 1 below. W2 shows the harmonic composition of the exclusive-or component with alternating polarity, i.e. with all three switches operating normally, but with the 120K ohm resistor removed. When operating normally, the square wave contribution to the harmonic composition of the combination must be scaled to 70% of the exclusive-or contribution to account for the $$\frac{202K \times 82K}{202K - 82K} = 138K \text{ ohm}$$

effective series resistance for the exclusive-or component. The total W2 + 0.7 W1 is normalized to the fundamental in line 5. The normalized harmonic composition after integration in the preamp is shown as W3.

TABLE 1

| SINE WAVE GENERATION | | | | | |
|---|---|---|---|---|---|
| | HARMONIC | | | | |
| WAVE FORM | 1 | 3 | 5 | 7 | 9 |
| W1 | 1.000 | 0.333 | 0.200 | 0.143 | 0.111 |
| W2 | 0.706 | −0.238 | −0.105 | 0.105 | 0.084 |
| 0.7W1 | 0.700 | 0.233 | 0.140 | 0.100 | 0.078 |
| W2 + 0.7 W1 | 1.412 | −0.005 | −0.010 | 0.205 | 0.162 |
| "(normalized) | 1.000 | −0.004 | −0.007 | 0.145 | 0.115 |
| W3 | 1.000 | −0.001 | −0.001 | 0.021 | 0.013 |

Figure 11B:
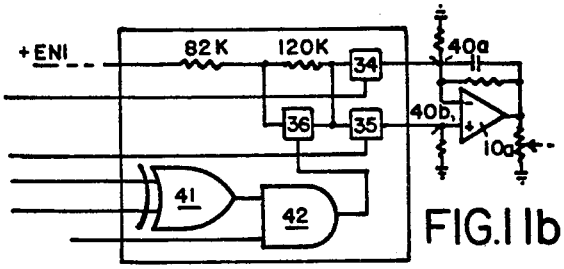
Figure 11C:
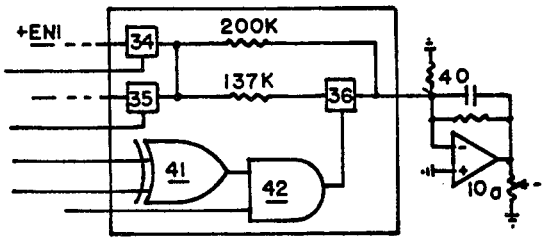
Figure 11D:
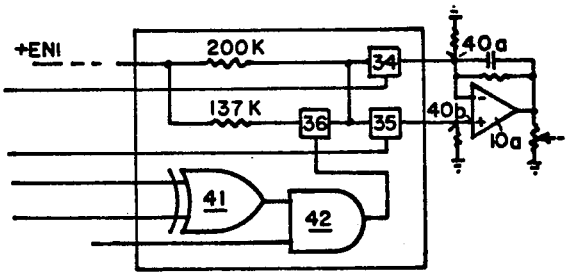

Instead of the series connected resistors, one of which is shunted by the third switch; the keyer can be mechanized using parallel connected resistors with the third switch connected in series with one, as shown in FIG. 11*c*. The sine wave keyer may also be reversed, as described for the square wave keyers, by using the differential inputs of the preamplifiers 10 to provide the polarity reversal in lieu of the bipolar envelope signals. Such reversal can be used with either the series or parallel resistor configuration, as shown in FIGS. 11*b* and 11*d*. Any of the four balanced configurations shown produces a balanced modulated signal at the preamp output.

It has previously been noted that the highest frequency divider outputs become inactive when notes at the upper end of the keyboard are played. AND gates, such as 42, are provided to enable the operation of the third, or modulation, switch, such as 36, to be inhibited when an input to the associated exclusive-or gate, such as 41, becomes inactive. Since this never happens for the first four harmonics, the control input to the gates, such as 42, for the SH–4H keyers is connected to +5v. This input is connected to the $\overline{Q5}$ output of the octave register 23 for keyers 5H–8H. These keyers become simple square wave keyers when so inhibited, but in all cases the third harmonic component in the square wave output is beyond the pass range of the audio output system.

Release

The keyswitches on conventional organ keyboards, such as disclosed in U.S. Pat. No. 3,251,923, occasionally cause brief interruptions in continuity of the circuit during release of the key. Several circuit precautions have been introduced to overcome such "contact chatter". Momentary interruptions of the first contacts, before the second contacts have opened, is ineffective to reset flip-flop 22 (FIG. 5) because of the connection of the output of gate 94 to an input of gate 95 respectively. After the second contacts open, gate 95 will respond to either momentary or permanent drop-outs. In either case flip-flop 22 is reset, but the RC circuit connected to the $\overline{Q}$ output disables the set input for a sufficient time to insure that spurious momentary reappearances of pulses on UA do not again set it.

Envelope Generator

Figure 8:
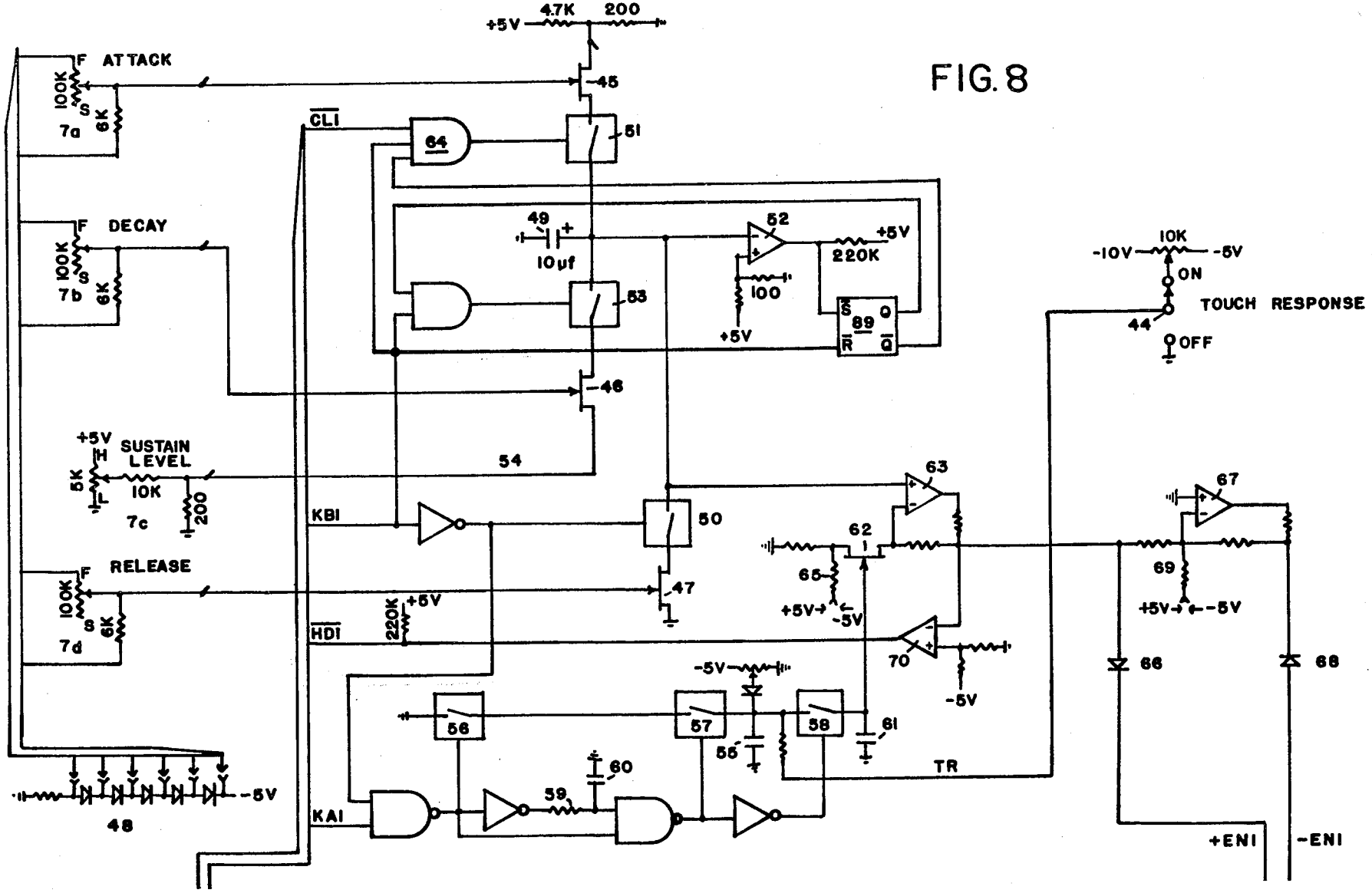
FIG. 8 is a schematic diagram of the envelope generator section of a note generator and the common ADSR controls.
Figure 9:
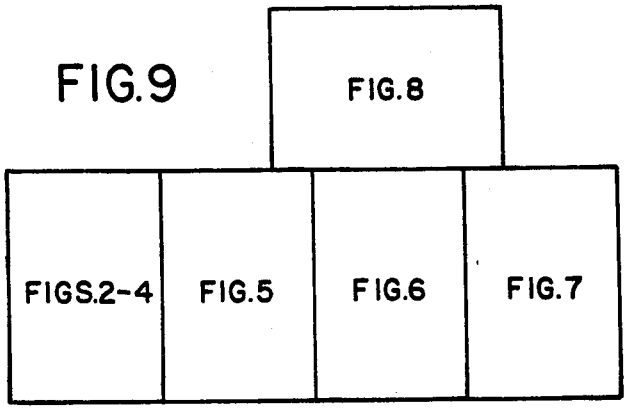
FIG. 9 shows how FIGS. 2 through 8 should be joined to make a unitary drawing of a complete organ.

The envelope generator schematic circuit, shown in FIG. 8, shows one of seven identical circuits together with a set of common ADSR controls and touch response selection switch 44. In general, the ATTACK *7a*, DECAY *7b* and RELEASE *7d* controls allow the gate voltage applied to the corresponding JFETS 45–47 to be varied over a range of several volts in the zero to minus five volt range. The exact range is determined by taps on a voltage divider 48 comprising five diodes connected in series between −5 volts and ground. Using diodes in lieu of resistors results in a lower impedance at the taps for the same bleed current through the series string. The SUSTAIN control *7c* developes a 0 to 100 mv signal across its 200 ohm output resistor.

Musical tone envelopes are generally exponential, hence are commonly generated using RC circuits. Varying the time constant in a number of RC circuits simultaneously can conveniently be done using JFETS, operated at source to drain voltage below 100 mv, as resistors which are controlled by a variable voltage between paralleled gates and paralleled sources. To minimize problems attendant upon use of low level DC signals, it is desirable to keep the envelope signal thus produced as large as possible consistent with the desire to use JFETS as approximately linear resistors.

The envelope generation will now be briefly described with reference to FIG. 8. The desired envelope waveform is developed across the 10 $\mu$f capacitor 49 which is initially shunted by switch 50 and transistor 47. The free terminal of 49 is consequently initially at ground. Switch 50 is turned off and 51 is turned on in response to depression of a playing key. Capacitor 49 charges towards 0.2 volts with a time constant determined by the voltage on the gate of transistor 45. When the charge on 49 reaches 0.1 volts comparator 52 triggers, setting flip-flop 89 which causes switch 51 to be turned off and 53 to be turned on. Capacitor 49 now discharges toward the sustaining level voltage, established on lead 54 by the SUSTAIN LEVEL control *7c*, with a time constant determined by the voltage on the gate of transistor 46. If the sustain level is 0.0 volts, a percussive envelope results. When the key is released, switch 53 is turned off and 50 is turned on to discharge capacitor 49 from the sustain level to 0.0 volts with a time constant determined by the voltage on the gate of transistor 47.

The operation of the envelope generator touch response operation is now described, again with reference to FIG. 8. Capacitor 55 is normally held at 0.0 volts by switches 56 and 57. Switch 56 is turned off when KA1 goes true in response to closure of the early keyswitch contacts. Capacitor 55 then starts charging toward the voltage on lead TR, typically −5 to −7 volts. When KB1 goes true, in response to closure of the final keyswitch contacts, switch 57 is turned off and 58 is turned on momentarily, due to the delay caused by resistor 59 and capacitor 60, to immediately charge capacitor 61 to the voltage on 55. Capacitor 55 is discharged immediately to 0.0 V when 57 is again turned on. Capacitor 61 is left floating at the final charge voltage reached by 55 to establish the resistance of field effect transistor 62 in the feedback loop around the operational amplifier 63. The gain of the amplifier circuit 63 is a linear function of the voltage applied to the gate of 62. The minimum voltage is set by the clamp diode and potentiometer shown above capacitor 55. When the TOUCH RESPONSE switch 44 is turned off lead TR is conncted to ground, hence 55 never discharges and 61 then floats at 0.0 volts independently of the key velocity. The amplifier circuit gain then remains constant at its maximum value.

The operation of the logic circuits to control the switches 50, 51 and 53, as described previously, is believed to be self-evident with one exception. The purpose of the $\overline{CL1}$ signal connection to the gate 64 at the top left of the drawing is to prevent the envelope signal from starting before the dividers in case they are held at zero awaiting synchronization with a harmonically related divider already in operation.

The DC offset of the operational amplifier 63 is trimmed (by a selected value for resistor 65 and by connecting it either to +5V or −5V) so that its output is normally slightly negative. The output diode 66 prevents developing any negative output on +EN1, which would result in an initial non-zero signal output. The operational amplifier 67 is connected as a unity gain inverting amplifier so as to produce at the cathode of diode 68 a mirror image of the signal at the anode of diode 66. The DC off-set of amplifier 67 is trimmed, by a selected resistor 69, to obtain a normal output that is slightly positive. The comparator 70 connected to the amplifier 63 output is biassed to trigger at about 0.1 volts, hence output $\overline{HD1}$ goes false at the outset of the envelope signal and remains false until the output on +EN1 has fallen practically to zero. The $\overline{HD1}$ signal keeps the dividers in the note generator NG-1 running until the audio output signal has dropped to a practically inaudible level.

In the envelope generator described in the foregoing individual field effect transistors are switched across an individual capacitor to charge, or discharge, it at appropriate times. In the modification shown in FIG. 12*a* the individual transistors 45, 46 and 47 have been made common to a set of envelope generators through use of a multiplexing arrangement. A timing signal TX has been connected to added inputs to the gates, such as 64, which control the analog switches, such as 51, to cause them to be switched on cyclically rather than continuously. The repetition rate of the timing signal must be above the audio range. The duty cycle is determined by the number of envelope generators which share the common transistors, such as 45. If the value of capacitor 49 remains unchanged, the effect resistance of the voltage controlled resistor 45 in an individual RC circuit increases inversely with the duty cycle of the timing signal, hence a lower resistance device is required to obtain a desired time constant. The effective resistance of the analog switches, such as 51, also increases inversely with duty cycle, hence can limit the maximum number of circuits that can be multiplexed. This limit can be extended by using a lower value for the capacitor 49, provided that the operational amplifier 52 and comparator 63, shown in FIG. 8, have low input bias currents. Devices having field effect transistor inputs have very low input bias currents and hence allow use of much smaller values for 49.

Figure 12A:
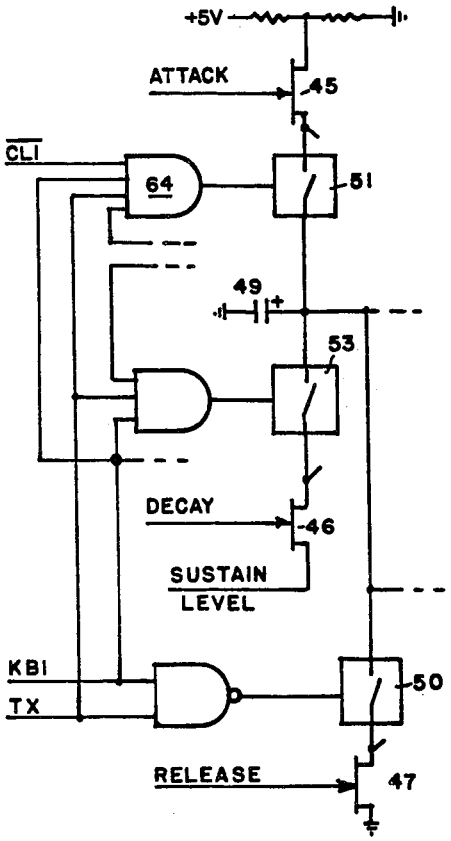
FIG. 12*a* is a schematic diagram showing a modification of the envelope generator in which multiplexing is used to enable a common set of voltage controlled resistors to be shared by all of the envelope generators associated with one manual of an organ.
Figure 12B:
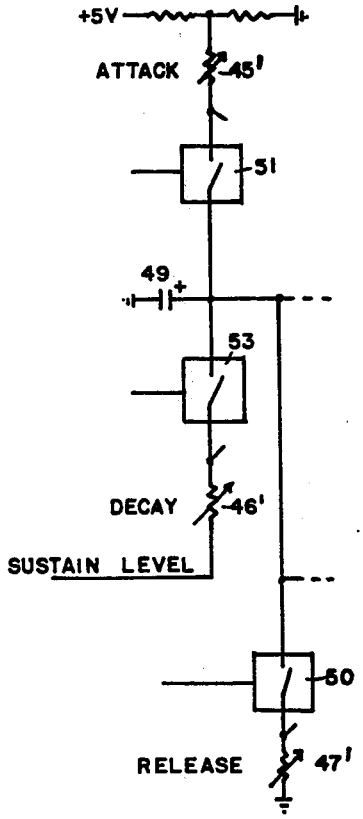
FIG. 12*b* is a schematic diagram showing a further modification of the envelope generator in which the common voltage controlled resistors of FIG. 12*a* are replaced with common manually controlled resistors.

The voltage controlled resistors 45–47 in FIG. 12*a* can be replaced with manually controlled resistors, as shown schematically in FIG. 12*b*, when this multiplexing arrangement is used. The physical placement of the circuit components must minimize the shunt capacity across the variable resistors to minimize cross coupling between envelope generators. The charge and discharge of capacitor 49 remains exponential in FIG. 12*b* and hence produces the desired musical effect.

Synchronizing Circuits

The present organ is believed to be the first in which independent dividers are at times driven from a common top octave source in response to operations of playing keys. This poses a unique problem in establishing proper phasing between the dividers so as to avoid cancellation of like frequency components in the divider outputs. In the illustrated spinet embodiment it is proposed that separate top octave dividers be used for the upper and lower manuals to obtain a desired choir effect, hence the phasing problem does not occur between notes produced by separate manuals. The principal problem occurs between octavely related notes on the same manual. Certain top octave dividers currently in commercial use also cuase a phasing problem between D and A and between D# and A# because these are perfect fifth (3/2) intervals rather than the irrational $2^{(7/12)}$ intervals required by equal temperament. The top octave dividers proposed herein eliminate these perfect fifth intervals so as to avoid this problem.

The synchronizing operation for octave intervals will now be described with reference to FIGS. 5 and 6. This always involves the seventh note generator NG-7 in the illustrated spinet embodiment. Let us assume that key C#3 is held down and C#4 is depressed later. Simultaneous key operation is permissible, since the multiplexing forces sequential electrical operation anyway, but successive operation is easier to describe. Key C#3 caused operation of NG-1 to generate note C#3 and to apply a pulse train at T1*a*. R3 time on lead LK1 to prevent NG-7 from responding to the coincident pulse train on UA. Control-1 also developed a pulse train at T1*a* (=T1.TA) time on lead BY1 to mark this time slot busy, as previously described. When key C#4 is depressed a pulse train appears on UA at T1*a*.R4 time in addition to the pulse train at T1*a*.R3 time due to key C#3. Control-1 does not respond to the former pulse train since flip-flop 22 is already set; but, even if it had been reset by the release of key C#3, it still could not be set by the T1*a*.R4 pulse train before the envelope generator had caused note C#3 to fully decay. Until this occurs, the $\overline{CL1}$ signal remains high whereby the pulse train at T1*a*.R3 time is maintained on lead LK1. The direct connection from the output of gate 24 to the input of gate 71 prevents the true signal on LK1 from inhibiting gate 93, hence flip-flop 22 is enabled to respond to repeated operations of keyswitch C#3 before the note has fully decayed, but not to any other keyswitches. An exception to this rule occurs when NG-7 is in use and unable to augment NG-1. In that case, lead CL7 is low and therefore holds the output of gate 71 high to make gate 93 responsive to any signals on UA which occur at T1 time.

Since we have assumed that NG-7 is idle, Control-7 will respond to the first pulse on UA at T1*a*.R4 time in a similar manner to that previously described for Control-1. The differences are that the latter is constrained to time slots T1*a* and T1*b* by the connection of lead T1X to lead T1, whereas the former is free to respond to pulses in any time slot by reason of the connection of its lead T7X to lead PC. Since the rise of pulse PC occurs at least 5 μs later than a concurrent pulse on UA, Control-1 had ample time to respond to the first T1*a*.R3 pulse (produced by playing key C#3) and lockout Control-7 before it was enabled to respond by the rise of PC.

Since there is no pulse on the LK7 input of Control-7 at T1*a*.R4 time, it responds as described in the following wherein the reference characters shown in the schematic diagram of Control-1 are employed to designate corresponding elements not shown in the block representation of Control-7. The T1*a*.R4 pulse on UA, which is actually T1*a*.R4.PB, produces pulse $\overline{T1a.R4.PC}$ at the output of gate 72, which sets flip-flop 22 and makes KA7 true. The rise of KA7 clocks a six state register 72 which controls a set of logic gates that perform a 7P6T selection function. Gates ST connect lead T7 to the particular timing signal, T1–T6, that happens to be true during the rise of KA7. Gates SX, SY and SZ select the corresponding pairs of top octave divider outputs. After this selection is performed, NG-7 is identical to the note generator it is augmenting.

The octave register 23 is clocked by KA7, making Q4 true, and flip-flop 25 is also clocked, setting it true and thereby causing 26 to select X7*a*, Y7*a*, Z7*a*, and TA. The TS7 pulse train and PD clocks flip-flop 28, FIG. 6, setting it true because WD7 is true at T1*a* time due to the pulse train set from NG-1 on BY1. With 28 true the output of gate 73 is held true to prevent $\overline{TS7} = \overline{T1a}$ from setting flip-flop 29 when KB7 subsequently becomes true. When this does occur it causes a pulse train at T1*a* time to appear on BY7 which is transmitted to WD1 of Control-1 to cause flip-flop 28 in Control-1 to be clocked true by TS1 = T1*a* and PD. 28 going true causes the continuous true signal on the reset input of flip-flop 74 to be replaced by XS1*g*. When the X1 divider reaches the all zero count $\overline{XG}$ goes true on the rise of XS1*g* and flip-flop 74 is clocked true, driving buss SN1 true and thereby setting flip-flop 29 in Control-7 true to start the dividers therein with the next rise of XS7*g*. Flip-flop 74 in Control-1 is reset by the fall XS1*g* and remains false until the X1 divider again reaches zero. The synchronizing pulses are transmitted by NG-1 until one of the two C# keys is released, but only the initial pulse is significant.

It was pointed out above that after seizure NG-7 functions the same as the note generator it augments. It should be apparent then that if key C#3 is released and another C# key, such as C#5, is depressed; or C#3 is reoperated after the X1 dividers have been stopped; that NG-7 will transmit synchronizing pulses to NG-1 in the same manner as described for the converse operation.

Synchronizer Modifications

The synchronizing circuits described in the foregoing are simpler than the modifications described hereinafter as a result of the use of independent top octave signal sources for each manual. When common sources are used three to more octavely related notes may be produced simultaneously from a common source. When an incoming note generator is being synchronized with two or more operating note generators, all of which are octavely related, it is essential that the incoming not generator be synchronized with the lowest frequency operating note generator. The synchronizer circuit shown in FIG. 6 and described in the foregoing is modified as shown in FIG. 10 to achieve this objective, thereby allowing use of a common set of top octave dividers for both manuals of the organ if the choir effect is relinquished.

Figure 10:
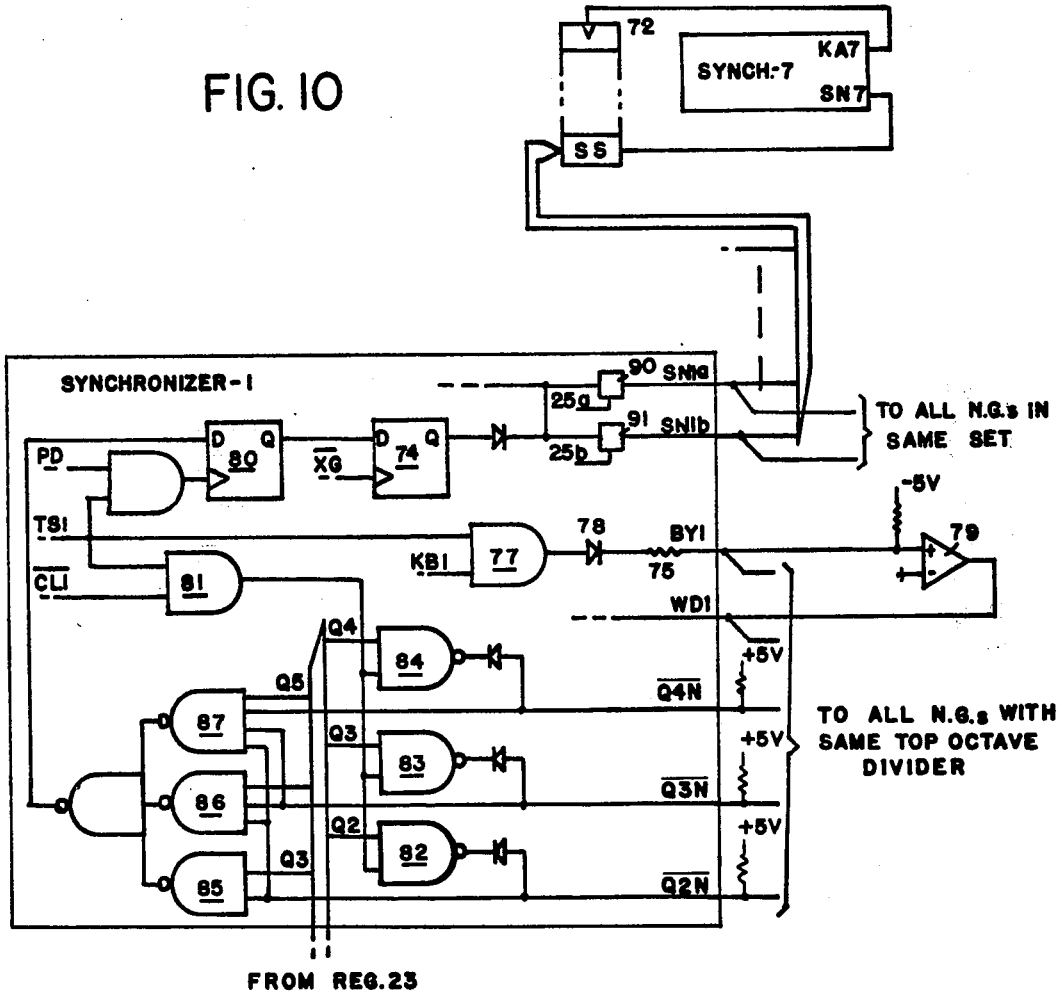
FIG. 10 is a schematic diagram of a modification of the synchronizer circuit for use in organs in which three or more octavely related note generators are operated concurrently from a common source.

Referring now to FIG. 10, a resistor 75 is added in series with the individual BY1 lead, which is connected to the BY leads of all note generators which share top octave dividers, including NG-7. The BY lead common is connected to −5V through a resistor 76 having a value of 0.82 times that of the resistors 75 individual to each note generator. The value "0.82" is based on an assumed voltage drop of 0.7 volts for the gate 77 and diode 78, and a logic supply voltage of 10V referenced to −5V. With these assumptions the voltage at the + input of comparator 79 is −0.8 volts when the BY lead common is driven in the positive direction by only one gate, such as 77, and is +0.8 volts when driven positive by two gates. Therefore the output of 79 is low at TS1 time if no other note generators assigned to this time slot are operating and the output is high if one or more such note generators have been siezed. The output of 79 is connected to the WD leads of all note generators having BY leads connected to its input, including NG-7. The function performed by 79 and the resistors, such as 75, connected to its input is commonly called a majority gate. The result achieved by this circuitry is to clock flip-flop 28 (FIG. 6) true if there is any other octavely related note generator operating in the set sharing the same top octave dividers.

In the unmodified synchronizing system the SN leads of seven note generators could be connected together since only one pair of note generators had to be synchronized at any given time. In the modified system several pairs may have to be synchronized at the same time. Therefore, the SN leads of only those note generators assigned to the same pair of notes, and sharing the same top octave dividers, are connected together. In full size organs, described later, there may be six or more note generators assigned to the same pair of notes. When four or more note generators are assigned to the same pair of notes it is possible, although unlikely musically, that two pairs will require synchronization simultaneously on each of the two notes assigned to them. To satisfy this contingency a pair of SN leads, such as SN1*a* and SN1*b*, are provided for each set of note generators. This requires that an additional 2P6T set of selection logic be added to Control-7 (FIG. 5) to connect SN7 (FIG. 6) to one of the six pairs of synchronizing leads SN1*a* and SN6*b* corresponding to the note generator that NG-7 is augmenting. Also, an additional 1P2T set of selection logic, shown as switches 90 and 91 in FIG. 10, must be added to the AND-OR SELECT gates 26 (FIG. 5) of all note generators.

In the unmodified synchronizer, FIG. 6, the D input of flip-flop 74 is connected to +5v so that it is clocked true by $\overline{XG}$ whenever its reset input is driven low as a result of a true input on WD1 signifying that two note generators are operating in the same time slot. In the modified circuit, FIG. 10, the D input of 74 is controlled by another flip-flop 80 which enables 74 only when NG-1 has its dividers running at a pitch lower than, or equal to, that of any other note generators in the same set.

Signal $\overline{CL1}$ becomes true when the dividers in NG-1 start and remains true until they are stopped. All this time gates 82–84 pull down one of the multiplex leads $\overline{Q2N}$ – $\overline{Q4N}$, in accordance with the octave register 23 (FIG. 5), during TS1 time. If Q5 is true none of the leads $\overline{Q2N}$ – $\overline{Q4N}$ is affected. These leads are connected to all note generators sharing the same top octave dividers. Gates 85–87 are connected to these multiplex leads and to Q3–Q5 from the octave register 23 (FIG. 5) of NG-1 so that the gate selected by the register will have all of its inputs true only when all lower ordered multiplex signals are also true. In other words, if there is another note generator operating at a lower octave pitch it will inhibit the selected gate. Operation at the same or higher octaves will not inhibit the selected gate. If none of the gates 85–87 is inhibited at TS1 time, flip-flop 80 will be clocked true and 74 will be enabled to transmit synchronizing pulses to SN1*a* or SN1*b*, if required. Flip-flop 28 (FIG. 6) determines whether or not synchronizing pulses are required, as previously explained. When two note generators are operating in the same octave interval, the gates 85–87 will not be inhibited in either one, hence both will transmit synchronizing pulses. This will cause no difficulty, since they will have been previously synchronized and consequently only one synchronizing pulse will appear on the corresponding "SN" buss.

Figure 15:
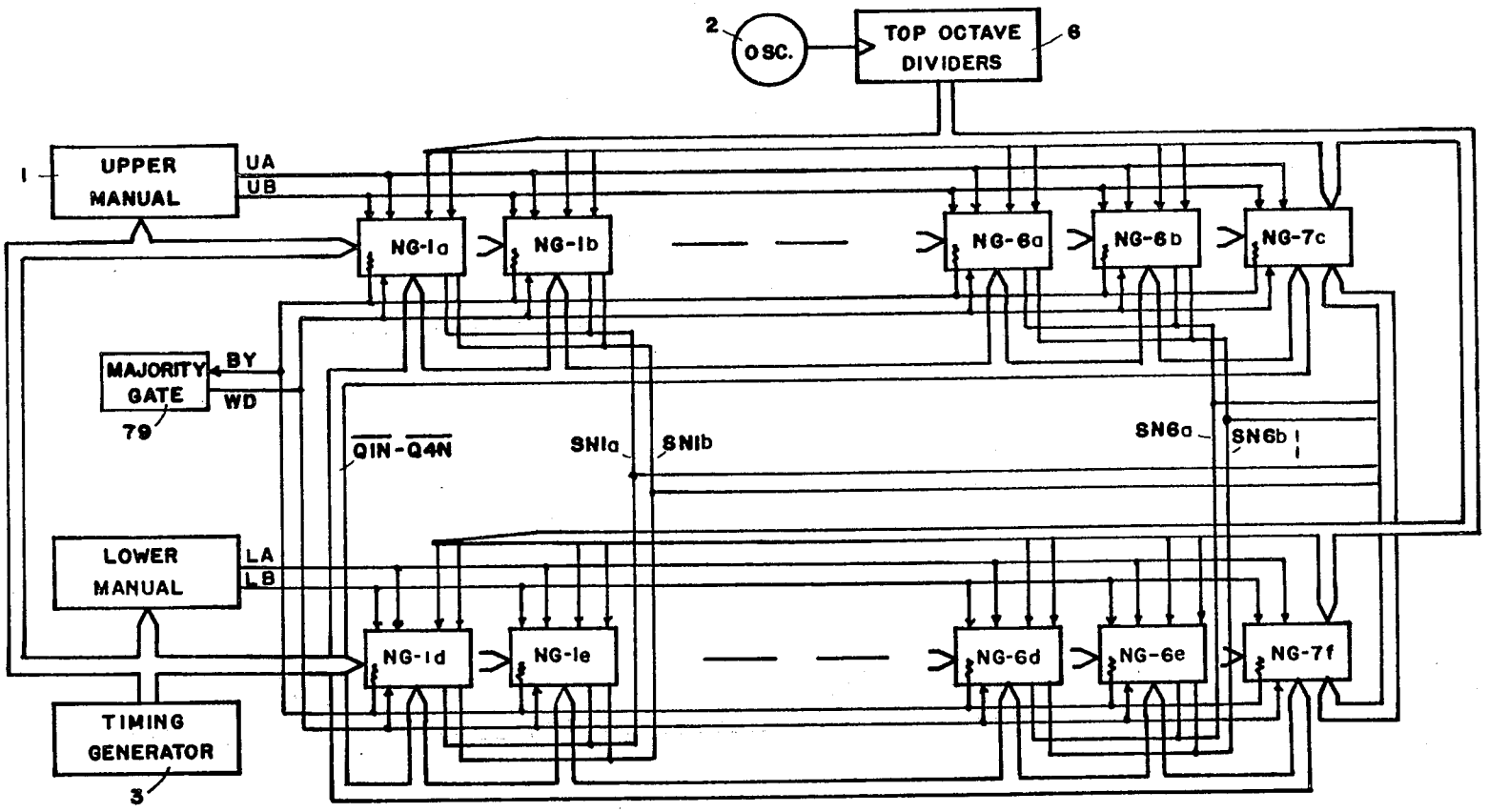
FIG. 15 is a block diagram of another embodiment of the invention illustrating the system organization for a full size two manual organ using the synchronizing circuits shown in detail in FIG. 10.

The above described synchronizer modification is also applicable to full size organ embodiments of the invention, such as that illustrated in block diagram form in FIG. 15. In such full size organs two hands are frequently used on the same manual and three or more notes in groups an octave or more apart frequently played together. In FIG. 15 a second set of six note generators is provided for each manual to accommodate the additional notes. These added note generators, such as NG-1*b*, are identical to the first set, such as NG-1*a*, except for the connection of the PC pulse to the "SG" control input, in the same manner as shown for Control-7 in FIG. 5. The SG-7 inputs are connected to a new pulse train similar to PC but delayed by five microseconds. The effect of the delayed pulses on the "SG" inputs is to cause the first key played to seize the corresponding generator in the "*a*" or "*d*" group, the second concurrently operated octavely related key seizes a corresponding generator in the "*b*" or "*e*" group, and finally the third key seizes the universal note generator NG-7*c* or NG-7*f*.

Figure 16:
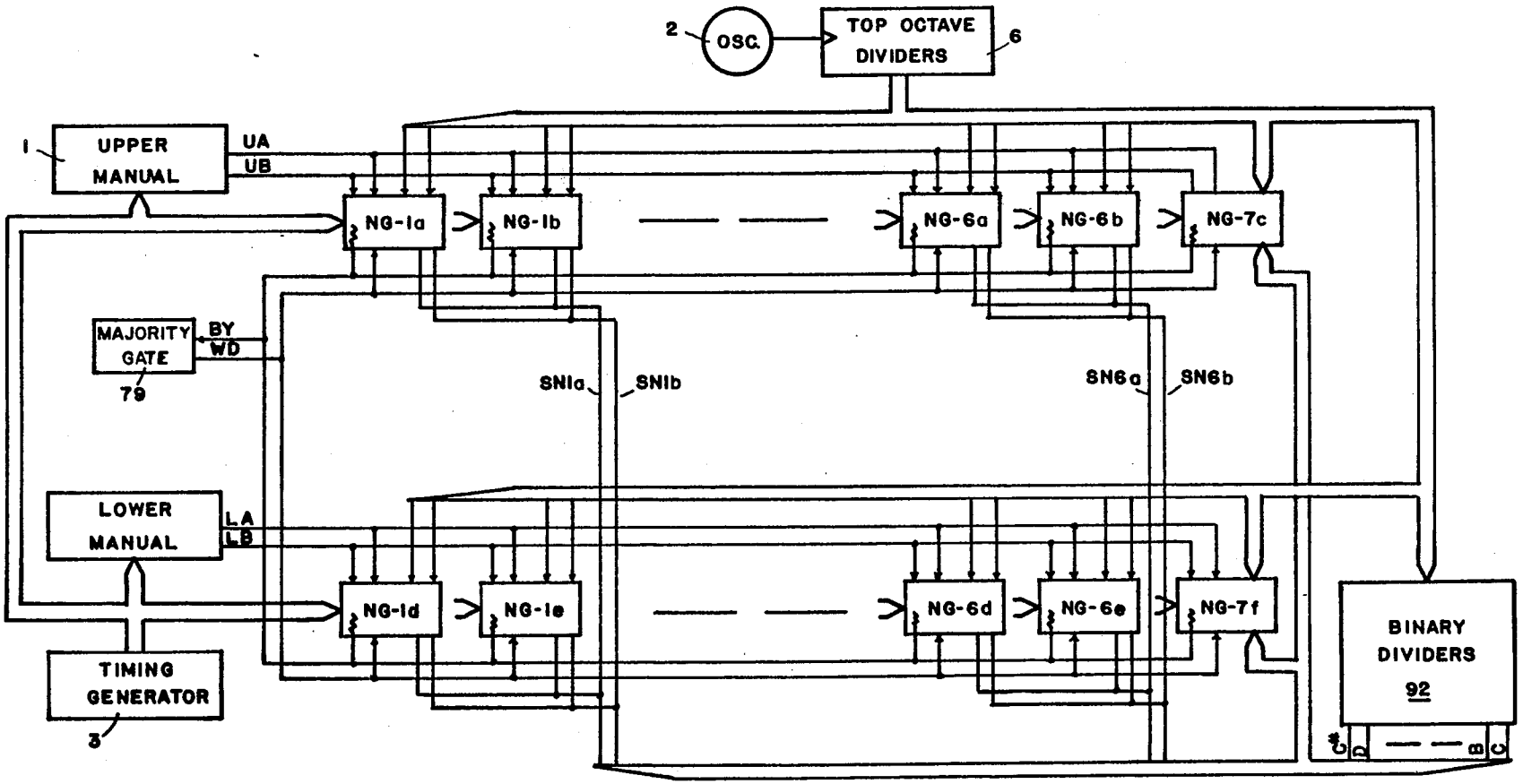
FIG. 16 is a block diagram of still another embodiment of the invention illustrating the system organization for a full size two manual organ using an auxiliary set of bottom octave signal sources to effect synchronization.

An alternate form of synchronizing system suitable for full size organs is illustrated in the organ shown in block diagram form in FIG. 16. In the synchronizing system used in this organ the majority gate 79, "SN" synchronizing busses, the selection switches 90 and 91 are retained. The remainder of the FIG. 10 circuitry is replaced by a set of twelve binary dividers 92, which extend to the lowest octave interval used in the organ. The bottom octave of these dividers is connected to the corresponding synchronizing busses SN1*a* to SN6*b*.

Rate Multiplier Modification

Separate sets of top octave dividers are shown in FIG. 2 for driving the octave (or binary) harmonic, third and sixth hormonic, and fifth harmonic dividers in the note generators. This arrangement results in ideal output waveforms, as shown in FIG. 14*c*, from the sine wave keyers, but requires six top octave signal inputs to each note generator. The number of circuits that can be incorporated in an LS1 package, and hence the cost per circuit, is a function of the number of pins required. By incorporating a rate multiplier in each note generator the number of top octave signal inputs is reduced from six to two.

Referring not to FIG. 13, the oscillator 1 has a frequency of 10.0808 Mhz which is divided by top octave dividers 6, having the divisor ratios shown in Table 1, to the twelve equal tempered frequencies between 17,717 hz and 33,491 hz. For convenience, these are referred to elsewhere in this application as top octave tone sources even though they are above the audible range.

Each note generator selects one of a pair of these sources, such as W1*a* and W1*b* and the selected source WS1 drives a pair of four stage Johnson counters 12*m* and 13*s* out of phase. The sixteen output states are encoded to obtain 8, 6 and 5 pulses per cycle on outputs XS1*g*, YS1*g* and ZS1*g*, respectively. Each of these outputs is connected to X, Y and Z binary dividers and their associated keyers, as shown in FIGS. 6 and 7, which were previously described.

The output current of all of the sine wave keyers driven by the X divider, i.e. the octave (or binary) harmonics, have the ideal waveform shown in FIG. 14*c*. The outputs of the 6H (sixth harmonic) keyers have the waveform shown in FIG. 14*a* for the top octave, i.e. 6,644 to 12,559 hz. It will be observed that every third half cycle is 20% wider than the others. Since this waveform is repeated at the frequency of the second harmonic and has left-right symmetry at the odd eighth wave points, there is no spurious subharmonic, fundamental, or harmonic component that is an even multiple of two present. At the next to the top octave the 6H keyers produce the output waveform shown in FIG. 14*d*, which is also the waveform of the 3H keyer outputs for the top octave. The asymmetry is now reduced to 10%. This waveform repeats at the frequency of the fundamental and has left-right symmetry about the odd quarter wave points. With reference to the top octave 3H output, there is no spurious subharmonic or even harmonic component present. With reference to the next to top octave 6H output, again there is no spurious subharmonic, fundamental, or harmonic component that is an even multiple of two present. The outputs of the 5H keyers for the top octave are shown in FIG. 14*b*. This waveform repeats at the frequency of the fundamental and has left-right symmetry about the odd one quarter wave points, hence there is no spurious subharmonic or even harmonic component present.

Each time the pitch is lowered an octave, the keyer output waveforms approach the ideal of FIG. 14*c* more closely and the spurious harmonic content caused by the dissymmetry introduced by the rate multiplier becomes infinitesimal in the comparison to the inherent residual harmonics in the ideal waveform.

Implementation

This most suitable components for the preferred embodiments of the invention described in the foregoing cannot be identified by any part numbers because the preferred implementation is in the form of LSI, which must be custom made. The LSI components may use several different technologies. The high speed (10 Mhz) top octave dividers may use bipolar transistors in $I^2L$ circuits or may use MOS transistors in complementary MOS circuits. The note generators, including the logic elements of the envelope generators, may be implemented economically with N or P type MOS using ion implantation to produce both enhancement and depletion mode devices on the same chip. This combination of devices enables economical fabrication of complementary type circuits, which is the preferred form of construction for the keyer portion of the note generators.

The JFETS, used as voltage controlled resistors, in the envelope generators are preferably fabricated in monolythic form so that all of the transistors with commoned gates are in one chip. This avoids the problem of selecting transistors for matched pinch-off voltages. The operational amplifiers and comparators may be quad circuits, such as National Semiconductor's LM324 and LM339, repectively; but very low input bias current devices using FET inputs, such as the RCA Type CA3130T operational amplifier, are preferable, particularly when the multiplexed arrangement is used.

Although the invention has been described and illustrated in detail, it is to be understood that the same is by way of illustration and example only, and is not to be taken by way of limitation. The spirit and scope of the invention is limited only by the terms of the appended claims.

I claim:

1. A source of square wave tone signals, an amplifier, a tone signal path connecting said source to said amplifier, a field effect transistor connected in said path so as to modulate the tone signal current flowing to said amplifier, and a second square wave signal source having twice the frequency of said first signal source connected to the gate of said transistor to operate it during the second and third quarter of each half cycle of the tone signal fundamental whereby the third and fifth harmonic components are substantially eliminated from the tone signal current.

2. A source of square wave tone signals in phase with sin $\omega t$, an amplifier, two resistors connected in a tone signal path between said source and said amplifier, a switch connected in circuit with said resistors to modulate the current flow in the tone signal path, and a source of square wave tone signals in phase with cos $2\omega t$ connected to said switch to operate it during alternate half cycles whereby the third and fifth harmonic components in the amplifier tone signal output are controlled in accordance with the ratio between said resistors.

3. An envelope generator, a differential preamplifier, a pair of field effect transistors each having one source/drain electrode connected to said generator and having the other source/drain electrode connected to a corresponding input of said amplifier, and a square wave tone signal source connected to the gate electrodes of said transistors so as to switch them on alternately, whereby a balanced modulated tone signal is produced at the output of said amplifier in response to operation of said envelope generator.

4. An envelope generator, a differential preamplifier, a resistor connected at one end to said generator, a pair of field effect transistors each having one electrode connected to the other end of said resistor and having another electrode connected to a corresponding input of said amplifier, and a square wave tone signal source connected to the gate electrodes of said transistors so as to switch them on alternately, whereby a balanced modulated tone signal is produced at the output of said amplifier in response to operation of said envelope generator.

5. An envelope generator, a preamplifier, two circuit paths connecting said generator to said preamplifier in a balanced configuration, a field effect transistor connected in each of said paths, a square wave signal source connected to the gates of said transistors to switch them on alternately whereby a balanced modulated tone signal is produced at the preamplifier output in response to an envelope signal from said generator, a third field effect transistor connected in said circuit paths so as to further modulate the tone signal current, and a second square wave signal source having twice the frequency of said first signal source connected to the gate of said third transistor to switch it on during the second and third quarters of each half cycle of the tone signal.

6. An envelope signal source, a preamplifier, a pair of switches and two resistors connected between said source and said preamplifier in a balanced configuration, a source of square wave tone signals in phase with sin $\omega t$ connected to said switches so as to close them alternately during successive half cycles, a third switch connected in circuit with said two resistors to vary the resistance of the circuit path between the envelope generator and the preamplifier, and a source of square wave tone signals in phase with cos $2\omega t$ connected to said third switch to close it during alternate half cycles, whereby the third and fifth harmonic components in the amplifier tone signal output are controlled in accordance with the ratio between said resistors.

7. An envelope signal source, a preamplifier, a pair of switches and two resistors in series connected between said source and said amplifier in a balanced configuration, a source of square wave tone signals in phase with sin $\omega t$ connected to said switches so as to close them alternately during successive half cycles, a third switch connected in shunt with one of said resistors, and a source of square wave tone signals in phase with cos $2\omega t$ connected to said third switch so as to close it during alternate half cycles, whereby the third and fifth harmonic components in the amplifier tone signal output are controlled in accordance with the ratio between said two resistors.

8. An envelope signal source, a preamplifier, a pair of switches and a first resistor connected between said source and said amplifier in a balanced configuration, a third switch and a second resistor in series connected in parallel with said first resistor, a source of square wave tone signals in phase with sin $\omega t$ connected to said pair of switches to close them alternately during successive half cycles, a source of square wave tone signals in phase with cos $2\omega t$ connected to said third switch to close it during alternate half cycles, whereby the third and fifth harmonic components in the tone signal at the preamplifier output are controlled in accordance with the ratio between said two resistors.

* * * * *